United States Patent [19]

Lerude

[11] 4,180,304

[45] Dec. 25, 1979

[54] DISSEMBLABLE MULTI-PART ELECTRICAL CONNECTOR

[75] Inventor: Gérard Lerude, Poitiers, France

[73] Assignee: La Telemecanique Electrique, France

[21] Appl. No.: 856,933

[22] Filed: Dec. 2, 1977

[30] Foreign Application Priority Data

Dec. 3, 1976 [FR] France ..... 76 36636

[51] Int. Cl.[2] ..... H01R 13/46; H01R 33/80

[52] U.S. Cl. ..... 339/196 M; 339/193 P

[58] Field of Search ..... 339/143 T, 144 T, 145, 339/192 T, 193, 196, 206

[56] References Cited

U.S. PATENT DOCUMENTS

| | | | |
|---|---|---|---|
| 1,872,678 | 8/1932 | Chamberlain | 339/196 M |
| 2,557,818 | 6/1951 | Eddy | 339/196 M |
| 3,109,124 | 10/1963 | Sinninger | 339/143 T |

FOREIGN PATENT DOCUMENTS

| | | | |
|---|---|---|---|
| 624053 | 5/1949 | United Kingdom | 339/196 M |

OTHER PUBLICATIONS

Electronic Design, 3M Advertisement, p. 141, Mar. 1960.

*Primary Examiner*—Neil Abrams

*Attorney, Agent, or Firm*—William Anthony Drucker

[57] ABSTRACT

An electrical appliance in which flexible conductors connect the terminals of the plug to the terminals of the body, the plug being divided into elements capable of being separated in order to facilitate soldering and then reassembled on installation, the arrangement being advantageous for small devices such as relays.

4 Claims, 4 Drawing Figures

Fig.3
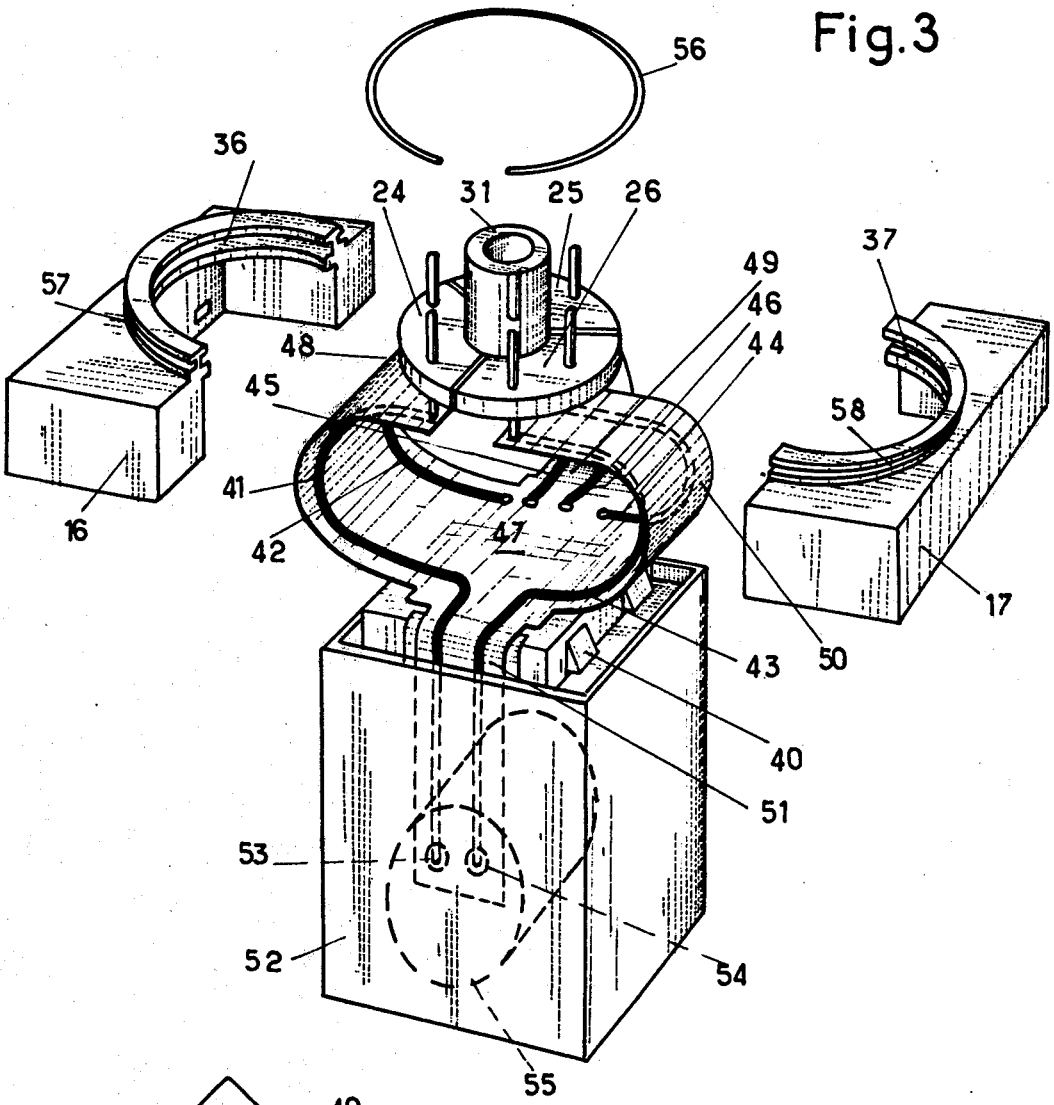
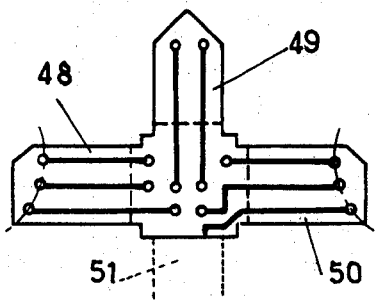
Fig. 4

DISSEMBLABLE MULTI-PART ELECTRICAL CONNECTOR

This invention relates to a connecting device for an electrical appliance comprising a body equipped with connecting pieces, a plug mechanically connected to the body and provided with output terminals, and a plurality of flexible conductors the ends of which are connected respectively to the connecting pieces and to the terminals.

THE PRIOR ART

Appliances are already known which correspond to the construction defined above. Thus the connection of numerous relays is effected in that way, the flexible conductors being generally composed of portions of flexible conductor under a sheath, bared at the ends and fixed by soldering the latter.

The drawback of this arrangement lies principally in the difficulty of access of the soldering points when the conductors are numerous, in the difficulty of performing the soldering, and in the practical impossibility of automating these operations.

OBJECT OF THE INVENTION

The invention sets out to remedy these drawbacks and to furnish as a result finished products offering an improved quality and regularity of manufacture.

SUMMARY OF THE INVENTION

According to the invention this result is achieved in that the plug is composed of several assembled elements, that each element carries some of the output terminals, and locating surfaces, that the flexible conductors are distributed in several sets of conductors of which the appropriate ends terminate on the output terminals of the element associated with one particular set, and that gripping means are provided for the assembling and holding of the elements with the help of locating surfaces, after the said ends have been fixed to the said terminals.

Other features and manufacturing variants will be better apparent from the following description with reference to the drawings.

BRIEF DESCRIPTION OF THE DRAWINGS

In the drawings:

FIG. 3 shows in perspective a modification of the apparatus according to the invention;

FIG. 4 is a plan view of a part of the appliance of FIG. 3.

DESCRIPTION OF THE PREFERRED EMBODIMENTS

Figure 1:
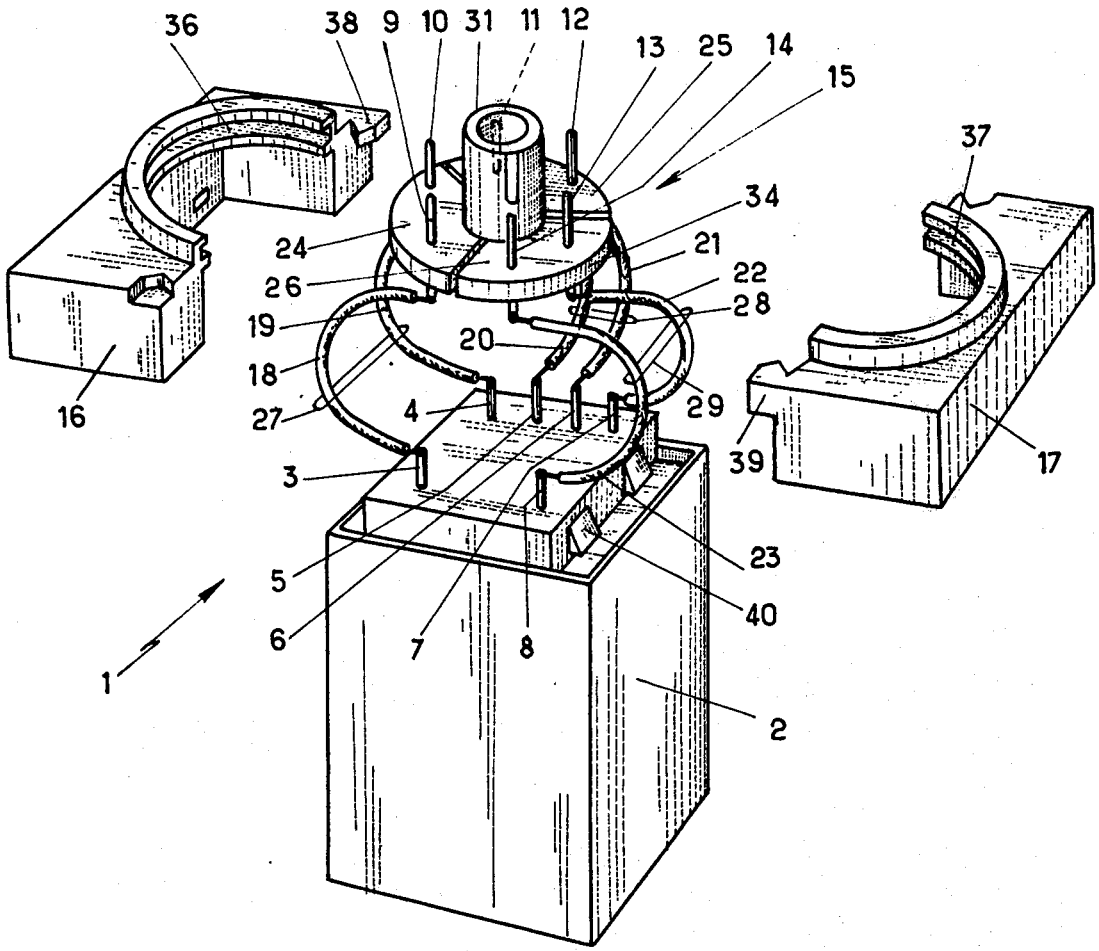
FIG. 1 shows, in perspective, an appliance according to the invention.

The electrical appliance 1 shown in FIG. 1 comprises a body 2 in the interior of which are arranged the circuits necessary for its function. The latter can be performed for example by a relay, a delayed-action switch or possibly a logic function of which the variables are of an electrical nature.

The connecting pieces of the body are represented by 3, 4, 5, 6, and 7, 8, without implying any limitation on the number and the position of these pieces by the example illustrated.

The output terminals 9, 10, 11, 12, 13 and 14 of the appliance are mounted on a plug, indicated generally by reference numeral 15, which will be connected to the body 2 by a connecting device comprising the members 16 and 17, of which all the functions will be described later herein.

Flexible conductors 18, 19, 20, 21, 22 and 23, each covered by an insulating sheath, serve to couple the connecting pieces to the respective output terminals, for example by soldering their ends onto the latter.

In the example illustrated, the plug carries the output terminals arranged on a circumference placed concentrically with an orientation spigot 31.

If the appliance thus described did not include complementary features, access to the soldering points would be difficult, unless the flexible conductors were made rather long, which would increase the congestion as a result, or unless the ends of these conductors were made to enter into the interior of the terminals, which would be predrilled with a longtitudinal hole and have their ends soldered together as is habitually done, but at the cost of a delicate operation and low security.

Figure 2:
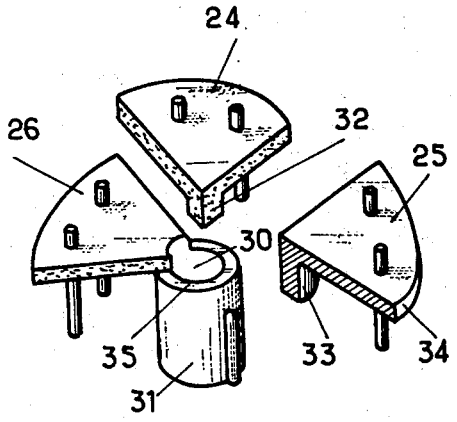
FIG. 2 illustrates a plug according to the invention.

In order to facilitate the coupling between terminals and connecting devices, the plug 15 has been divided into several complementary elements 24, 25, 26, each carrying a proportion of the output terminals, i.e. 9-10, 11-12, and 13-14 respectively, see also FIG. 2.

In order to simplify this division, flexible conductors have been grouped in their turn into several independent sets of conductors 27, 28, 29, i.e. in such a way that none of the conductors of a set overlaps or mingles with one or more of the conductors of another set.

When it is possible, this distribution of conductors will be determined by the desire either to make their length as small as possible, or to arrange for the proximity of conductors of analogous function, or to arrange for the conductors terminating on neighbouring terminals to run parallel, or again to take into account the standards governing the position of the output terminals on the plug according to their function.

By reasons of the division of the plug and of the formation of sets of conductors, it will be extremely easy to separate out the elements of the plug for carrying out the soldering operations, whether these are carried out by hand or by mechanized methods; in particular, in the latter case, the portions to be soldered will be, for example, maintained by appropriate means (not the subject of the invention) in the same plane so as to permit the operation of a dipping or of a wave process.

After soldering, the check for good quality of work can be carried out in a very easy way.

The assembly, after soldering, of the different elements of the plug must be made taking into account the dimensional tolerances allowing the disposition of the plug on an appropriate support. These elements will therefore be furnished with means or surfaces for locating and pegging so as to avoid wrong order and assuring perfection of assembly.

In FIG. 2 are shown, in a non-restrictive way, means for the achievement of this result.

One of the elements of the plug, in the form of a sector of a circle, represented by 26, carries a concave cylindrical guiding surface 30 arranged in the interior of the orientation spigot 31 and integral with it. The other elements 24 and 25 are also in the form of a sector of a circle, but their central portion is provided with centering devices 32 and 33 respectively, each having a cylindrical surface which will engage with the cylindrical surface 30, the angular position being itself fixed by the values given to the angles of the different sectors. When the centering pieces 32, 33 are introduced axially into the opening carrying the surface 30 so as to effect the contact of the sectors with the transverse surface 35 of the spigot 31, the plug is reassembled and can therefore be held and connected to the body of the appliance by the complementary pieces 16 and 17. Each of the latter includes, for example, a groove 36 and 37 respectively, the dimensions of which permit the reception of the periphery 34 of the plug. In the forms illustrated the grooves and the periphery in question are in cylindrical form, although any other form could be used.

The two pieces 16, 17 are held in relation to one another, for example, with the aid of hooks 38, 39, so as to form a solid body with the plug 15, and are then associated with body 2 with which they will be integrated in their turn, for example with the help of hooks 40 sliding into recesses in the said body.

It is also possible to use a single element to effect the purposes fulfilled by the elements 16 and 17. In this case, not illustrated, the external surface 34 of the plug could be slid axially into the interior of the lateral cylindrical surface of an opening in the single piece and could be held to this by resilient deformation.

An important feature in the invention is shown in FIG. 3, where the different sets of flexible conductors are represented by thin metallic ribbons, 41-42, 43-44 and 45-46, which adhere to or are held against, a thin and deformable insulating support 47. This thin insulating support, sometimes known as a flexible printed circuit, carries at least as many extensions 48, 49, 50, capable of being folded, as there are distinct elements of the plug, which is also represented in FIG. 4, wherein the dotted lines represent the areas of folding of the insulating support when extended. The pieces 16 and 17 play here the same part as in the preceding example, but in order to enable them to be coupled together by an annular spring 56, each is provided with part of a projecting flange 57 and 58 respectively.

Referring again to FIG. 3, it will be seen that the thin insulating support 47 can have a supplementary extension 51, partly indicated by dotted lines, which enters into the body 52 in order to carry the conductors intended to couple up the connecting pieces 53, 54 of a component 55 of the appliance which could itself be removable, for example the coil of a relay.

In addition, the locating surfaces mentioned above for assuring the alignment of the elements of the plug can be represented by the portions of surface 34 borne by each element, the surfaces of the grooves 36 and 37 of the pieces 16 and 17 performing in addition, apart from their function of mechanical holding, an orientation function.

The invention is in no way limited to the examples and applications described; furthermore the number of elements forming the plug and the disposition of the terminals which they carry can be freely chosen.

I claim:

1. A connecting device for an electrical appliance, said electrical appliance having a body provided with electrical connecting pieces, the said connecting device comprising:

(a) an insulating plug provided with output terminals which are spaced regularly and each of which includes a connecting extremity (b) flexible electric conductors connecting the connecting pieces and the connecting extremities of the output terminals, and (c) connecting devices for securing the plug to the said body, wherein:

(i) said plug is constituted by a plurality of elements of insulating material (ii) each said plug element carries a plurality of output terminals (iii) the flexible electrical conductors attached to two neighboring connecting extremities of respective output terminals carried by the same plug element run parallel to each other up to the said body and have such a length and such a flexibility that the plug elements can be moved into a first position in which said plug elements are separated out and lie flat substantially in the same plane as the flexible conductors, and into a second position in which said flexible electrical conductors are folded and the plug elements are disposed in contact with each other in a further plane and are held together by said connecting devices.

2. A connected device, according to claim 1, wherein the plug has a centrally arranged orientation spigot, the said output terminals being arranged on a circle surrounding the said spigot, each of the plug elements being in the form of a sector of a circle, and having cylindrical surfaces cooperating with the spigot.

3. A connecting device, for an electrical appliance, as claimed in claim 1, wherein said flexible electrical conductors are arranged on a flexible insulating support having flexible extensions, there being at least as many such flexible extensions as there are insulating elements of the plug.

4. A connecting device, according to claim 3, wherein the said insulating and flexible electrical conductor has a further extension which centers the said body, said extension cooperating with further connecting pieces of the said body.

* * * * *